US012629587B2

(12) United States Patent
Branch

(10) Patent No.: US 12,629,587 B2
(45) Date of Patent: May 19, 2026

(54) WALL MOUNTED JIGSAW PUZZLE WORK SURFACE AND STORAGE SYSTEM

(71) Applicant: David A. Branch, Orrington, ME (US)

(72) Inventor: David A. Branch, Orrington, ME (US)

( * ) Notice: Subject to any disclaimer, the term of this patent is extended or adjusted under 35 U.S.C. 154(b) by 60 days.

(21) Appl. No.: 18/626,218

(22) Filed: Apr. 3, 2024

(65) Prior Publication Data

US 2025/0312685 A1 Oct. 9, 2025

(51) Int. Cl.
*A63F 9/10* (2006.01)
*A63F 9/00* (2006.01)

(52) U.S. Cl.
CPC .... *A63F 9/1044* (2013.01); *A63F 2009/0032* (2013.01); *A63F 2009/1055* (2013.01)

(58) Field of Classification Search
CPC ..... A63F 9/1044; A63F 2009/0032; A63F 2009/1055
USPC ..... 108/115, 38, 42, 134; 312/248; 273/156, 273/157 A, 157 R
See application file for complete search history.

(56) References Cited

U.S. PATENT DOCUMENTS 346,838 A * 8/1886 Butler et al.
1,428,957 A * 9/1922 Hall ..... A47B 67/02 108/38
2,275,373 A * 3/1942 Barrett ..... A47B 63/02 312/300
2,924,443 A * 2/1960 Townsend ..... G01G 19/44 177/126
4,302,013 A * 11/1981 Kavis ..... A63F 9/1044 273/157 R
4,479,651 A * 10/1984 LaFleur ..... A63F 9/1044 273/DIG. 30
4,486,018 A * 12/1984 Keller, Jr. ..... A63F 9/1044 220/377
4,949,850 A * 8/1990 Weathers ..... B43K 23/002 24/11 C
5,082,336 A * 1/1992 Munch ..... H02B 1/306 D6/555
2009/0189497 A1* 7/2009 Stenbakken ..... A47B 81/00 312/248
2021/0252381 A1* 8/2021 Paulhamus ..... A63F 9/1044

FOREIGN PATENT DOCUMENTS

GB 2203056 * 10/1988 ..... A63F 9/10

* cited by examiner

*Primary Examiner* — James O Hansen
(74) *Attorney, Agent, or Firm* — Anthony D. Pellegrini

(57) ABSTRACT

A wall mounted jigsaw puzzle work surface and storage system configured to be attached to a wall and having a working mode and a storage mode, where in the working mode a working surface folds out from the wall, providing a puzzle maker with a working surface onto which a jigsaw puzzle may be assembled, and in the storage mode a securing member is placed onto the working surface and secured thereto, retaining the jigsaw puzzle pieces in their desired positions between the securing member and the working surface while the working surface is folded up into the storage system.

19 Claims, 8 Drawing Sheets

WALL MOUNTED JIGSAW PUZZLE WORK SURFACE AND STORAGE SYSTEM

BACKGROUND OF THE INVENTION

The activity of assembling jigsaw puzzles has become an increasingly popular pastime in recent years as one of the few activities that can be done alone or with others as an activity able to unite different generations. However, many homes no longer have the traditional working space for assembling jigsaw puzzles, namely, vacant formal dining room tables. Indeed, it is rare for the modern home to have any large, vacant flat working space to use for the assembly of jigsaw puzzles, other than, perhaps, a section of floor. In addition to the difficulties in finding a work space for the immediate assembly of jigsaw puzzles, there is also the temporal factor: that is, jigsaw puzzles, and especially larger or more complex jigsaw puzzles, are rarely able to be completely assembled in one sitting, meaning that whatever work space has been found must be occupied by the partially assembled jigsaw puzzle for potentially lengthy periods of time, until the jigsaw puzzle has been completed or abandoned. The alternative is to move the incomplete jigsaw puzzle between assembly sessions, but that presupposes that there is another location that can accommodate the work, and also introduces the risk that the movement of the incomplete puzzle may result in accidental disassembly of some or even all of the jigsaw puzzle. Moreover, just the act of having to move a partially completed jigsaw puzzle at the end of one assembly session and then retrieving it before beginning the next assembly session increases the inconvenience of the activity and greatly detracts from the enjoyment of assembling the jigsaw puzzle.

For those who are fortunate enough to have dedicated work spaces that can remain occupied by a partially assembled jigsaw puzzle for an ongoing period of time, the above described difficulties do not apply. But for all others, there is a need for a means of obtaining a work space for assembling jigsaw puzzles and which are available for the period of time that is required to completely assemble the jigsaw puzzles. This need is especially dire in smaller living spaces, such as studio apartments, where space is at a premium and dedicated jigsaw puzzle assembly spaces are not practical.

Puzzle storage devices are known in the art, but these devices only address the problem of moving a partially assembled jigsaw puzzle between assembly sessions. A work space is still needed, and the transference of a partially completed jigsaw puzzle to a puzzle storage device and then from the puzzle storage device back to a work space is time consuming and risks accidental disassembly. It also diminishes the likelihood of spontaneously engaging in assembly activity, or of short assembly sessions, because of the start up and take down time requirements.

It is therefore shown that there is a need for a space-saving jigsaw puzzle work station that can be readily accessed to provide a puzzle assembly work space when an assembly session is desired, and quickly put out of the way when the assembly session is completed. Moreover, there is a need for a jigsaw puzzle work station that can quickly secure an incomplete jigsaw puzzle and safely store it away with all puzzle pieces secured in the locations where they were last placed, and just as quickly allow retrieval of the incomplete jigsaw puzzle with all pieces in the exact positions where they were previously placed.

It is therefore an object of the present invention to provide a space-saving jigsaw puzzle work station that is mountable to a wall.

It is a further object of the present invention to provide a space-saving jigsaw puzzle work station that comprises a fold out working surface suitable for assembling a jigsaw puzzle thereon.

It is yet a further object of the present invention to provide a space-saving jigsaw puzzle work station that provides a securing means for securing jigsaw puzzle pieces onto the working surface once an assembly session is completed so that the working surface can be folded out of the way without disrupting the placement of the jigsaw puzzle pieces.

It is yet a further object of the present invention to provide a space-saving jigsaw puzzle work station that is aesthetically pleasing.

It is yet a further object of the present invention to provide a space-saving jigsaw puzzle work station that serves as a display device for a finished jigsaw puzzle.

Other objects of the present invention will be readily apparent from the description that follows.

SUMMARY OF THE INVENTION

The wall mounted jigsaw puzzle work surface and storage system of the present invention takes its inspiration from the so-called "Murphy Bed", which is a space saving bed that folds up against a wall when it is not being used. One embodiment of the present invention comprises a wall mounted frame that when not in use is stored vertically against a wall, out of the way, but when jigsaw puzzle assembly activity is desired a working surface folds away from the wall and provides a horizontal work space for jigsaw puzzle assembly. In addition to the frame, there is a working surface and a securing member. The working surface provides a convenient surface upon which to assemble a jigsaw puzzle. The securing member is placed onto the partially completed jigsaw puzzle when the assembly session is terminated, retaining the puzzle pieces in place and ready for storage. The securing member has a compressible surface that faces the jigsaw puzzle pieces, and when the securing member is placed onto the working surface and secured thereto, the compressible surface exerts a force against the jigsaw puzzle pieces so that movement of the working surface will not dislodge the jigsaw puzzle pieces from the positions where they were last placed. The working surface can then be folded up and out of the way. The action of unfolding the working surface and removing the securing member from the jigsaw puzzle pieces takes mere seconds, and the action of securing the jigsaw puzzle pieces with the securing member and folding the working surface out of the way similarly takes mere seconds. As a result, spontaneous assembly sessions are encouraged. In addition to its practicality, the wall mounted jigsaw puzzle work surface and storage system of the present invention may be crafted in the manner of fine cabinetry, thereby providing an aesthetically pleasing addition to any living space.

The present invention may also be used as a display device for a partially completed or completed jigsaw puzzle. Depending on the configuration, the jigsaw puzzle may be visible even when the working surface is folded up and out of the way. This can be achieved by having a transparent surface onto which the jigsaw puzzle may be placed, with the jigsaw puzzle visible through this transparent surface.

It is to be understood that the foregoing and following description of the invention is intended to be illustrative and exemplary rather than restrictive of the invention as claimed. These and other aspects, advantages, and features of the invention will become apparent to those skilled in the art after review of the entire specification, accompanying figures, and claims.

DETAILED DESCRIPTION OF THE DRAWINGS

DETAILED DESCRIPTION OF THE INVENTION

Figure 1:
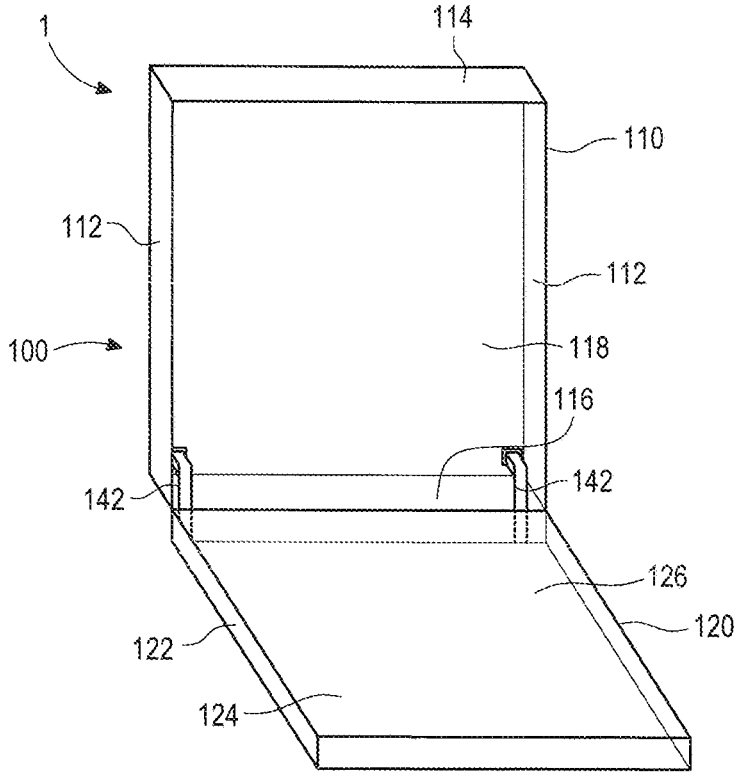
FIG. 1 depicts a perspective view of one embodiment of the invention, whereby the frame comprises an upper frame and a lower frame, and further depicting the device in working mode.

In one embodiment, the wall mounted jigsaw puzzle work surface and storage system 1 of the present invention comprises a frame 100, a working surface 200, and a securing member 300. The frame 100 is comprised of a lower frame 120 and an attachment member 180. The frame 100 is configured to be secured to a wall 20 by the attachment member 180. The lower frame 120 is configured to support the working surface 200. The working surface 200 is configured to support one or more jigsaw puzzle pieces 12 (the jigsaw puzzle pieces 12 may be either in the form of an incomplete jigsaw puzzle 10 or in the form of a completed jigsaw puzzle 10). The securing member 300 is configured to be placed onto the working surface 200.

Figure 2A:
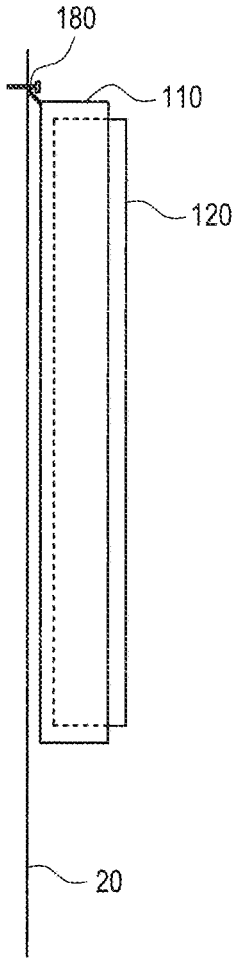
FIG. 2A depicts a side plan view of an embodiment of the invention, with the device depicted in storage mode. Portions of the lower frame are shown in ghost line.
Figure 2B:
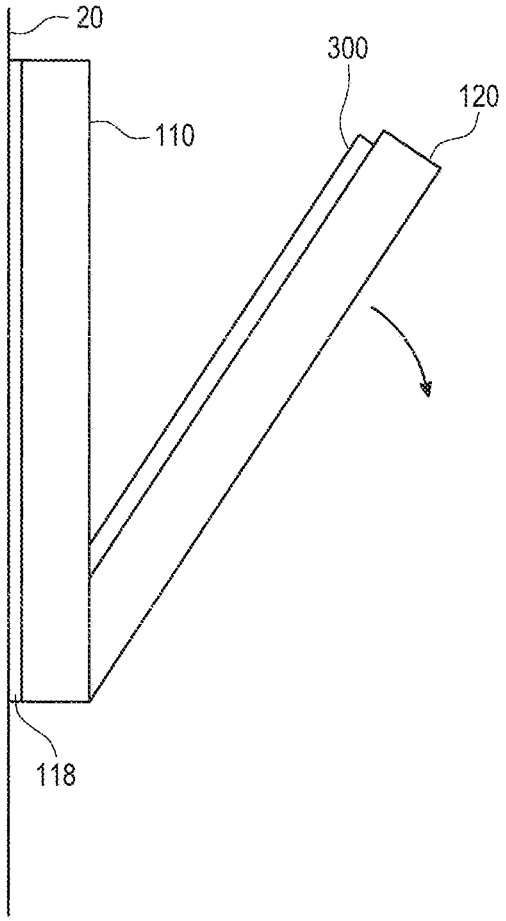
FIG. 2B depicts a side plan view of the embodiment of the invention shown in FIG. 1, with the device depicted transitioning from storage mode to working mode.
Figure 3:
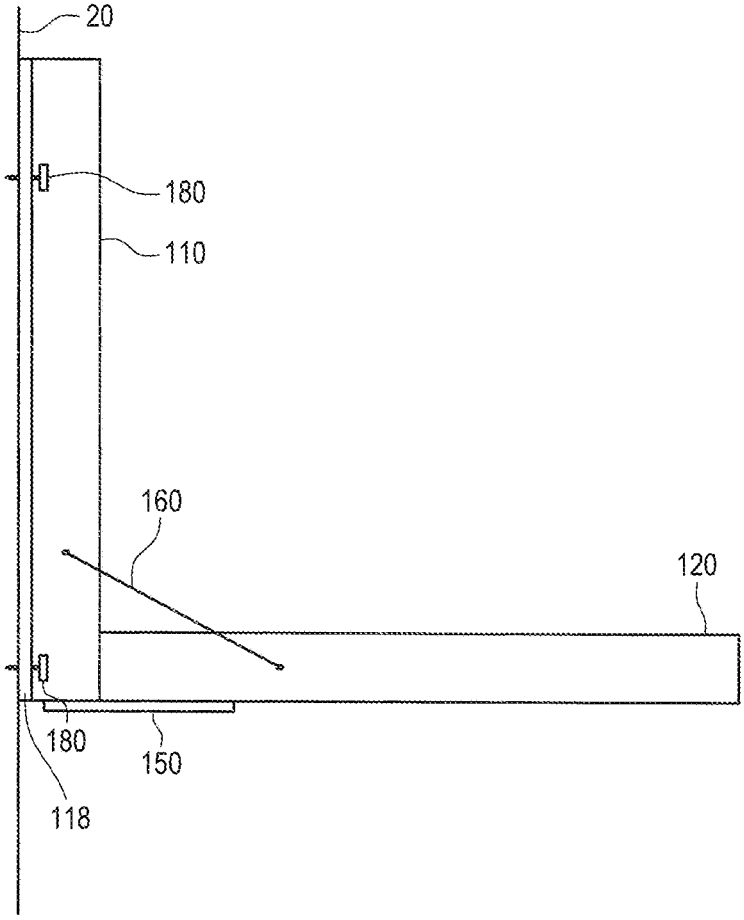
FIG. 3 depicts a side plan view of the embodiment of the invention shown in FIG. 1, showing two separate means for retaining the device in working mode.

The frame 100 has a storage mode and a working mode. When the frame 100 is in storage mode, the lower frame 120 is oriented substantially vertically. (See FIG. 2A.) When the frame 100 is in working mode, the lower frame 120 is oriented substantially horizontally at a substantially ninety degree angle to the wall 20. (See FIG. 3.) The frame 100 may also be neither in working mode nor storage mode, but rather in transition from one mode to the other mode. (See FIG. 2B.)

The securing member 300 is a substantially rigid, substantially planar member configured to be placed onto the working surface 200 to secure one or more jigsaw puzzle pieces 12 to the working surface 200 when the frame 100 is in storage mode. The securing member 300 also secures one or more jigsaw puzzle pieces 12 to the working surface 200 when the frame 100 is in transition between storage mode and working mode. When the frame 100 is in working mode, the securing member 300 is configured to be removable from the working surface 200, thereby uncovering any jigsaw puzzle pieces 12 that may have been placed thereon. Additionally, removing the securing member 300 from the working surface 200 allows jigsaw puzzle pieces 12 to be placed onto and removed from the working surface 200.

In one embodiment, the frame 100 is further comprised of an upper frame 110. The upper frame 110 may be comprised of a pair of lateral sides 112, a top side 114, and a bottom side 116, with the four sides of the upper frame 110 forming a substantially rectangular structure having an interior space 118. (See FIG. 1.) The upper frame 110 may also have a back panel, where the back panel closes off the rectangular structure of the upper frame 110 and is oriented against the wall 20. The a pair of lateral sides 112, the top side 114, the bottom side 116, and the optional back panel may all be constructed from hardwood in the manner of fine finished cabinetry. Other materials may also be used for these elements, such as metal, plastics, composites, and other materials having substantial rigidity and durability.

The upper frame 110 is configured to be secured to the wall 20 by the attachment member 180. See FIGS. 2A and 2B.) The attachment member 180 may be comprised of fasteners, such as nails or screws, which are placed through the upper frame 110 and into the wall 20. Alternatively, the attachment member 180 may comprise typical picture frame hanging hardware as is known in the art.

Figure 4:
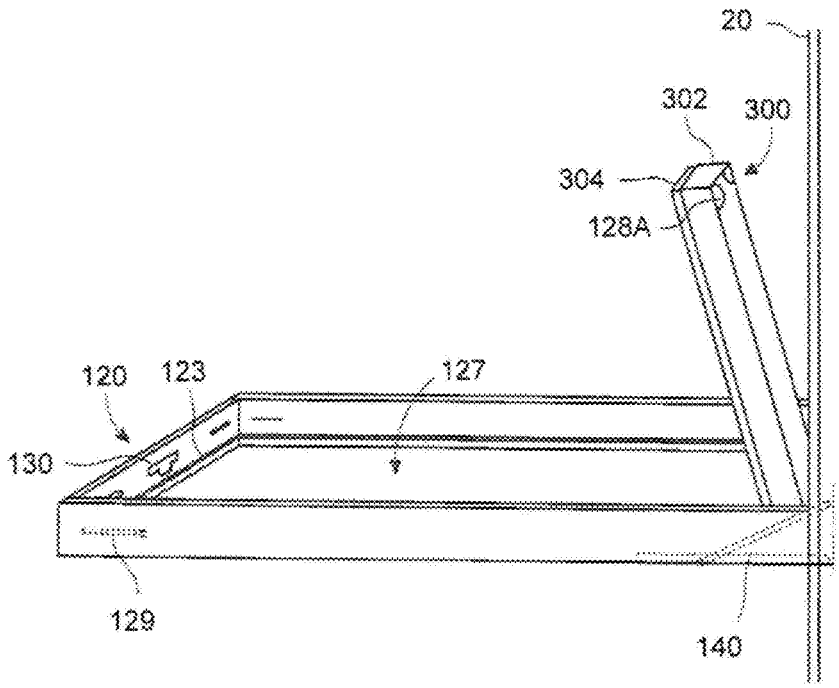
FIG. 4 depicts a perspective view of an alternative embodiment of the invention, whereby the frame does not comprise an upper frame, and further depicting the device in working mode and the securing member transitioning between working mode and storage mode.

The lower frame 120 is pivotally attached to the upper frame 110 by a pivotal attachment mechanism 140. (See FIG. 4.) The pivotal attachment mechanism 140 may be comprised of pivot fasteners passing through aligned apertures in the upper frame 110 and lower frame 120. In a preferred embodiment, the pivotal attachment mechanism 140 comprises a frame hinge mechanism 142 that is located within the interior space 118 of the upper frame 110 proximate to the bottom side 116 of the upper frame 110. (See FIG. 1.) The frame hinge mechanism 142 may be a pair of lateral hinges. In another embodiment, the frame hinge mechanism 142 may be one or more piano hinges. In other embodiments, the frame hinge mechanism 142 may be different pivoting mechanisms as are known in the art.

The lower frame 120 may be dimensioned such that when the frame 100 is in storage mode at least a portion of the lower frame 120 is located within the interior space 118 of the upper frame 110. In some embodiments, the lower frame 120 is dimensioned such that when the frame 100 is in storage mode the entirety of the lower frame 120 is located within the interior space 118 of the upper frame 110. In alternative embodiments, the lower frame 120 is only partially retained within the interior space 118 of the upper frame 110 when the frame 100 is in storage mode. (See FIG. 2A.) In the preferred embodiment, the lower frame 120 is rectangular. The lower frame 120 may be partially or entirely retained within the interior space 118 of the upper frame 110 by one or more retaining devices 130. The retaining device 130 may be a latch, a clasp, a hook, a hook and loop fastener, a magnet, a chain, a cord, a rotating flange, any combination of one or more of the foregoing, or any other device or mechanism known in the art that is capable of retaining the lower frame 120 within the interior space 118 of the upper frame 110.

The lower frame 120 may be retained in a substantially horizontal orientation (thereby placing the frame 100 into working mode) by any number of means. In one embodiment utilizing a frame hinge mechanism 142, the frame hinge mechanism 142 itself is configured to retain the lower frame 120 in a substantially horizontal orientation. This embodiment requires the frame hinge mechanism 142 to be very sturdy, and thus lateral hinges may be preferable to piano hinges. In another embodiment, at least a portion of the bottom side 116 of the upper frame 110 extends outwardly in relation to the lateral sides 112 of the upper frame 110. This creates a shelf upon which a portion of the lower frame 120 rests when the frame 100 is in working mode. In yet another embodiment, the upper frame 110 may comprise one or more stop members 150. Each said stop member 150 is located on the bottom side 116 of the upper frame 110 and extends outwardly therefrom. At least a portion of the lower frame 120 then rests on at least a portion of the one or more stop members 150 when the frame 100 is in working mode. In yet another embodiment, the stop members 150 may be pivoting, where they pivoted out from the bottom side 116 of the upper frame 100 only when it is desired to place the frame 100 into working mode, and when the frame 100 is not in working mode the stop members 150 may be pivoted so that they are located in their entirety below the bottom side 116 of the frame 100. (See FIG. 3.) In yet another embodiment, the upper frame 110 comprises a cord 160 or light chain having a fixed length. One end of the cord 160 or chain is attached to one of the lateral sides 112 of the upper frame 110, and the other end of the cord 160 or chain is attached to a corresponding side of the lower frame 120. When the frame 100 is not in working mode, the cord 160 or chain is slack, and when the frame 100 is in working mode the cord 160 or chain is extended to its full length, thereby preventing the lower frame 120 from pivoting to an orientation beyond the horizontal. (See FIG. 3.) A second cord 160 or chain may be located on the opposite side of the frame 100 as the first cord 160 or chain, adding stability to the frame 100. In yet another embodiment, the upper frame 110 comprises an extendable slider 170. The extendable slider 170 has a first component and a second component, with the first component having a longitudinal notch and the second component having a projection configured to fit within and slide along the slot of the first component. One end of one of the components of the slider 170 is pivotally attached to one of the lateral sides 112 of the upper frame 110, and one end of the other component of the slider 170 is pivotally attached to a corresponding side of the lower frame 120. When the frame 100 is not in working mode the projection of the second component of the slider 170 is located within the slot of the first component of the slider 170 at an intermediate location such that the slider 170 is not fully extended, and when the frame 100 is in working mode the projection of the second component of the slider 170 is located at an extreme end of the slot of the first component of the slider 170 such that the slider 170 is fully extended, thereby preventing the lower frame 120 from pivoting to an orientation beyond the horizontal. A second slider 170 may be located on the opposite side of the frame 100 as the first slider 170, adding stability to the frame 100. In yet other embodiments, combinations of the foregoing means may be used, for example, the shelf formed by the bottom side 116 of the upper frame 110 in combination with a pair of cords 160. Other means for retaining the lower frame 120 in a horizontal orientation when the frame 100 is in working mode are also contemplated by this invention.

The lower frame 120 may have various configurations. In one embodiment, the lower frame 120 is substantially planar and comprises a perimeter 122 and an interior portion 124 circumscribed by the perimeter 122. The perimeter 122 may be defined by a pair of lateral sides and a front side and a back side. In this embodiment, the lower frame 120 is substantially rectangular. The sides of the lower frame 120 made be constructed of the same materials as the upper frame 110. (See FIG. 1.)

In one embodiment of the lower frame 120, the lower frame 120 comprises a base panel 126 located within its interior 124. The base panel 126 may be opaque, and made of the same materials as the sides of the lower frame 120, or it may be made of different materials. In one embodiment, the base panel 126 is transparent. Where the base panel 126 is transparent, an image may be placed upon it, face down, so that the image can be viewed through the transparent base panel 126 when the frame 100 is in storage mode. Alternatively, a completed jigsaw puzzle 10 may be placed face down on the transparent base panel 126, allowing it to be viewed when the frame 100 is in storage mode. In some embodiments, the base panel 126 of the lower frame 120 is removable from the lower frame 120. In this embodiment, the removable base panel 126 of the lower frame 120 acts as the working surface 200 of the device 1. In another embodiment, a non-removable base panel 126 acts as the working surface 200.

In yet another embodiment of the lower frame 120, the interior of the lower frame 120 has an opening 127 in its bottom. (See FIG. 4.) That is, there is no base panel 126 located within the lower frame 120. In this embodiment, there may be an interior peripheral ledge 123 within the lower frame 120 that extends onto the interior 124 of the lower frame 120. (See FIG. 4.) The ledge 123 must be wide enough to sufficiently support the working surface 200 when the working surface 200 is placed into the lower frame 120 within the interior 124 of the lower frame 120. The ledge 123 may be continuous or discontinuous.

Figure 5:
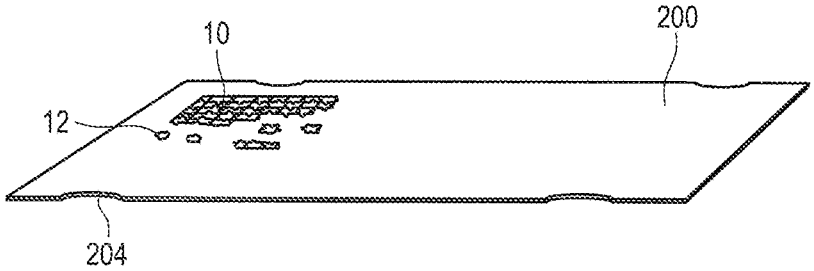
FIG. 5 depicts a perspective view of one embodiment of the working surface, with a partially completed jigsaw puzzle thereon as well as unassembled jigsaw puzzle pieces.
Figure 6:
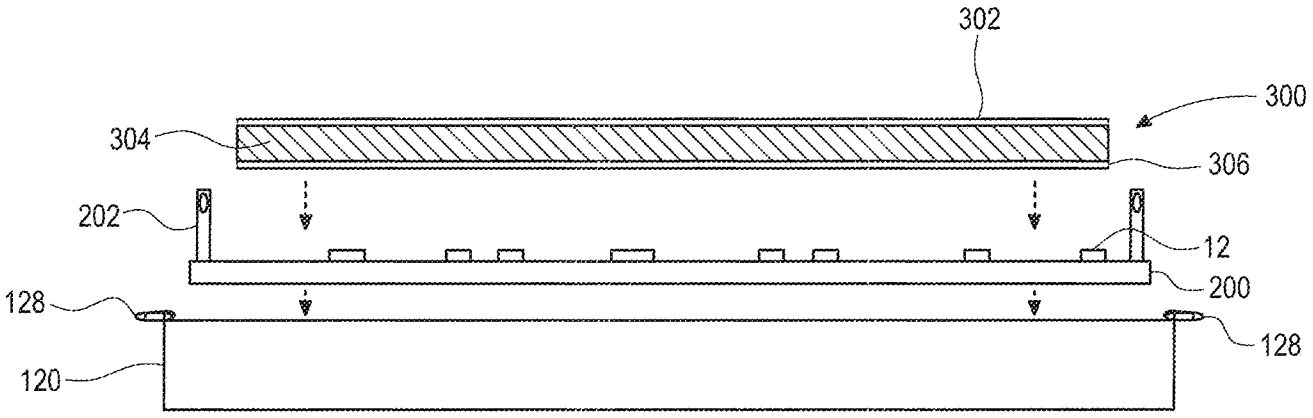
FIG. 6 depicts a front plan view of one embodiment of the lower frame, the working surface, and the securing member, showing the securing member being placed onto the working surface and on top of the jigsaw puzzle pieces, and the working surface being placed into the lower frame.

In preferred embodiments, the working surface 200 is removable from the lower frame 120. In these embodiments, the working surface may comprise one or more peripheral handles 202 to facilitate its removal from the lower frame 120. (See FIG. 6.) Alternately, the working surface 200 may comprise one or more peripheral notches 204 to facilitate its removal from the lower frame 120. (See FIG. 5.)

The working surface may be opaque, and made of the same materials as the sides of the lower frame 120, or it may be made of different materials. In another embodiment, the working surface 200 is transparent. A transparent working surface 200 could be used in conjunction with a transparent base panel 126, or where there is no base panel 126 and the interior of the lower frame 120 is opened, to allow for the display of a jigsaw puzzle 10. A completed jigsaw puzzle 10 may be placed face down on the transparent working surface 200, allowing it to be viewed when the frame 100 is in storage mode.

Figure 7A:
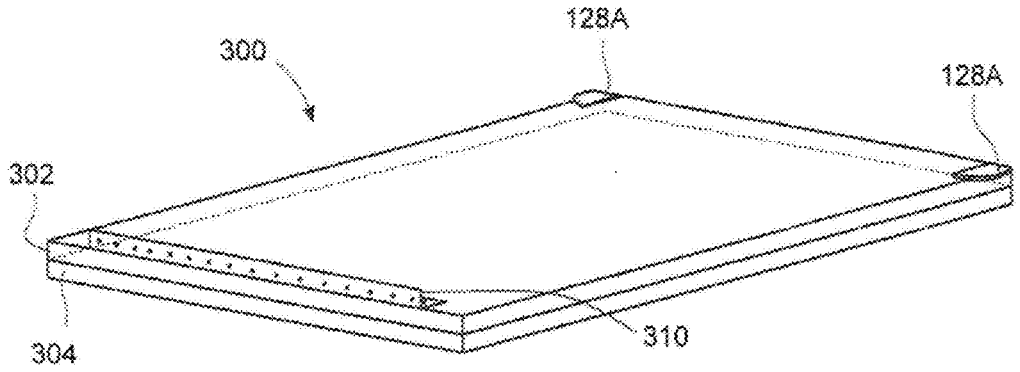
FIG. 7A depicts a perspective top view of one embodiment of the securing member.
Figure 7B:
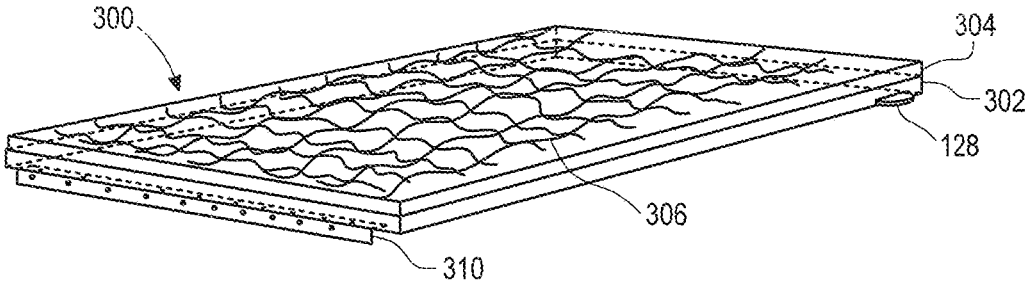
FIG. 7B depicts a perspective bottom view of the embodiment of the securing member shown in FIG. 7B.

The securing member 300 is a substantially rigid member that is dimensioned to fit entirely within the interior space 118 of the upper frame 110 when the frame 100 is in storage mode. The securing member 300 may be attached to the upper frame 110 by a securing hinge mechanism 310. The securing hinge mechanism 310 may be a pair of hinges or one or more piano hinges, or any other hinge mechanism known in the art. (See FIGS. 7A and 7B.) In one embodiment, the securing hinge mechanism 310 may be located within the interior space 118 of the upper frame 110 proximate to the bottom side 116 of the upper frame 110, and it may be attached to one or both of the lateral sides of the upper frame 110. Alternatively, the securing hinge mechanism 310 may be attached to the optional back panel of the upper frame 110. In yet another embodiment, the securing hinge mechanism 310 may be attached to the lower frame 120, at a location proximate to the pivotal attachment mechanism 140 attaching the lower frame 120 to the upper frame 110. In all of the foregoing embodiments, the securing member 300 is hingedly attached to the frame 100, and is pivoted to cover or uncover the work surface 200 and any jigsaw puzzle pieces 12 thereon. (See FIG. 4.) In these embodiments, the securing member 300 may be partially or entirely retained within the interior space 118 of the upper frame 110 by one or more retention devices. The retention device may be a latch, a clasp, a hook, a hook and loop fastener, a magnet, a chain, a cord, a rotating flange, any combination of one or more of the foregoing, or any other device or mechanism known in the art that is capable of retaining the securing member 300 within the interior space 118 of the upper frame 110. In embodiments where the lower frame 120 is attached directly to the wall 20, the hinged securing member 300 may be retained against the wall 20 by one or more retention devices as described herein.

In other embodiments, the securing member 300 is fully removable from the frame 100. (See FIG. 6.) It may be placed onto the work surface 200 to cover or uncover the work surface 200 and any jigsaw puzzle pieces 12 thereon, and may be removed from the work surface 200.

In all embodiments, whether the securing member 300 is pivotally attached to the frame 100 or removable from the frame 100, the securing member 300 must be able to be secured to the work surface 200. In one embodiment, where a securing hinge mechanism 310 is used, the lower frame 120 comprises a pair of pivoting flanges 128, with each of the pivoting flanges 128 being located on the lower frame 120 at a location distal from the securing hinge mechanism 310. (See FIG. 6.) The pivoting flanges 128 are located on opposite sides of the lower frame 120 from each other. Each pivoting flange 128 is configured to extend, when pivoted, into the interior portion 124 of the lower frame 120 and over the securing member 300 when the securing member 300 is placed onto working surface 200 within the lower frame 120. As such, each of the pair of pivoting flanges 128 presses down on the securing member 300 to firmly press the securing member 300 against the working surface 200 and any jigsaw puzzle pieces 12 located thereon. Each pivoting flange 128 can also be pivoted away from the securing member 300, thereby permitting the securing member 300 to be removed from the working surface 200 and any jigsaw puzzle pieces 12 located thereon. In one embodiment, the pivoting flanges 128 are located on a top edge of the lower frame 120. In another embodiment, similarly configured pivoting flanges 128A are located on the outer member 302 of the securing member 300 and pivot to fit within horizontal grooves 129 formed into the lateral sides of the lower frame. (See FIG. 4; see also FIG. 7A). In embodiments where no securing hinge mechanism 310 is used, and the securing member 300 is fully removable from the frame 100, a plurality of pivoting flanges 128 may be found on the lower frame 120, configured as described above, and dispersed about the perimeter of the lower frame 120; alternatively, a plurality of pivoting flanges 128A may be found on the outer member 302 of the securing member 300, with corresponding grooves 129 located on the lower frame 120. In other embodiments, clamps or other securing devices may be used to hold the securing member 300 firmly against the work surface 200.

In the preferred embodiment, the securing member 300 comprises a substantially rigid outer member 302 attached to a compressible inner layer 304. (See FIGS. 6, 7A, and 7B.) The inner layer 304 is oriented towards the working surface 200 when the securing member 300 is placed thereon. When the frame 100 is in storage mode or when the frame 100 is in transition between storage mode and working mode, the inner layer 304 of the securing member 300 is in contact with the working surface 200 and the one or more jigsaw puzzle pieces 12 placed onto the working surface 200. The outer member 302 of the securing member 300 may be made of the same materials as the lower frame 120, or from different materials. The inner layer 304 of the securing member 300 may be made of a compressible foam or plastic material. In one embodiment, the inner layer 304 is removable and replaceable. In the preferred embodiment, the inner layer 304 is air permeable, so that the placement of the securing member 300 onto the working surface 200 does not create undue air turbulence that might otherwise move the jigsaw puzzle pieces 12 from their desired positions. This air permeability may be a characteristic of the material from which the inner layer 304 is made, or it may be the result of having channels formed into the inner layer 304. In the most preferred embodiment, the securing member 300 further comprises a non-stick contact layer 306 that is attached to the inner layer 304 of the securing member 300 on the surface of the inner layer 304 opposite the outer member 302 of the securing member 300. (See FIG. 7B.) The contact layer 306 of the securing member 300 is in contact with the jigsaw puzzle pieces 12 when the securing member 300 is placed onto the working surface. The contact layer 306 acts to reduce the incidence of jigsaw puzzle pieces 12 sticking to the securing member 300 when the securing member 300 is removed from the working surface 200. The contact layer 306 may be made of a thin plastic film material, or a fine mesh netting material, or other materials that have the property of minimizing attraction of the jigsaw puzzle pieces 12. In one embodiment, the contact layer 306 is removable and replaceable.

In embodiments where the frame 100 does not comprise an upper frame 110, the attachment member 180 of the frame 100 hingedly attaches the lower frame 120 directly to the wall 20. (See FIG. 4.) In these embodiments, the attachment member 180 is the pivotal attachment mechanism 142, as described above. The pivotal attachment mechanism 142 may be attached to wall studs by fasteners such as screws or nails. The lower frame 120 is held against the wall 20 when the frame 100 is in storage mode by the retaining device 130, as described above.

In yet other embodiments of the invention, the frame 100 may include one or more lighting devices located within the interior space 118 of the upper frame 110. The one or more lighting devices can be any appropriate lighting fixtures known in the art, including battery operated lighting, lighting connected to an external power supply, colored lighting, L.E.D. lighting, or any other known and useful lighting. The use of lighting devices within the frame allows for the work surface 200 to be properly illuminated when the frame 100 is in working mode, regardless of the existing ambient light.

These and other embodiments are contemplated by the present invention. While the preferred embodiments of the present invention have been described, modifications can be made and other embodiments may be devised without departing from the spirit of the invention.

I claim:

1. A wall mounted jigsaw puzzle work surface and storage system, said system comprising a frame, a working surface, and a securing member, wherein the frame is comprised of a lower frame, an upper frame, and an attachment member, the upper frame is configured to be secured to a wall by the attachment member, the lower frame is pivotally attached to the upper frame by a pivotal attachment mechanism, the lower frame is configured to support the working surface, and the frame has a storage mode and a working mode, whereby when the frame is in storage mode the lower frame is oriented substantially vertically, and when the frame is in working mode the lower frame is oriented substantially horizontally;

the working surface is a substantially rigid, substantially planar member configured to be placed onto the lower frame and is further configured to support one or more jigsaw puzzle pieces, said jigsaw puzzle pieces forming either an incomplete jigsaw puzzle or a completed jigsaw puzzle; and the securing member is configured to be placed onto the working surface to secure the one or more jigsaw puzzle pieces to the working surface when the frame is in storage mode and when the frame is in transition between storage mode and working mode, and the securing member is further configured to be removable from the working surface when the frame is in working mode, with the securing member being a substantially rigid member attached to the lower frame by a securing hinge mechanism that is located proximate to an end of the lower frame that is proximate to the pivotal attachment mechanism of the lower frame to the upper frame;

wherein the lower frame further comprises a pair of pivoting flanges, with each said pivoting flange located on a top edge of the perimeter of the lower frame distal from the location of the securing hinge mechanism and on opposite sides of the lower frame from each other, and with each pivoting flange configured to extend into the interior portion of the lower frame and over the securing member when the securing member is placed onto working surface within the lower frame, such that each of the said plurality of pivoting flanges presses the securing member firmly against the working surface and any jigsaw puzzle pieces located thereon, and with each pivoting flange further configured to be pivoted away from the securing member thereby permitting the securing member to be removed from the working surface and any jigsaw puzzle pieces located thereon.

2. A wall mounted jigsaw puzzle work surface and storage system, said system comprising a frame, a working surface, and a securing member, wherein the frame is comprised of a lower frame, an upper frame, and an attachment member, the upper frame is configured to be secured to a wall by the attachment member, the lower frame is pivotally attached to the upper frame by a pivotal attachment mechanism, the lower frame is configured to support the working surface, and the frame has a storage mode and a working mode, whereby when the frame is in storage mode the lower frame is oriented substantially vertically, and when the frame is in working mode the lower frame is oriented substantially horizontally;

the working surface is a substantially rigid, substantially planar member configured to be placed onto the lower frame and is further configured to support one or more jigsaw puzzle pieces, said jigsaw puzzle pieces forming either an incomplete jigsaw puzzle or a completed jigsaw puzzle; and the securing member is configured to be placed onto the working surface to secure the one or more jigsaw puzzle pieces to the working surface when the frame is in storage mode and when the frame is in transition between storage mode and working mode, and the securing member is further configured to be removable from the working surface when the frame is in working mode, with the securing member being a substantially rigid member attached to the lower frame by a securing hinge mechanism that is located proximate to an end of the lower frame that is proximate to the pivotal attachment mechanism of the lower frame to the upper frame;

wherein the securing member further comprises a pair of pivoting flanges, with each said pivoting flange located on an upper surface of the securing member distal from the location of the securing hinge mechanism and on opposite sides of the securing member from each other, and with each pivoting flange configured to extend into a corresponding groove formed into the perimeter of the lower frame when the securing member is placed onto working surface within the lower frame, such that each of the said plurality of pivoting flanges presses the securing member firmly against the working surface and any jigsaw puzzle pieces located thereon, and with each pivoting flange further configured to be pivoted away from the perimeter of the lower frame permitting the securing member to be removed from the working surface and any jigsaw puzzle pieces located thereon.

3. A wall mounted jigsaw puzzle work surface and storage system, said system comprising a frame, a working surface, and a securing member, wherein the frame is comprised of a lower frame and an attachment member, the frame is configured to be secured to a wall by the attachment member, the lower frame is configured to support the working surface, and the frame has a storage mode and a working mode, whereby when the frame is in storage mode the lower frame is oriented substantially vertically, and when the frame is in working mode the lower frame is oriented substantially horizontally;

the working surface is a substantially rigid, substantially planar member configured to be placed onto the lower frame and is further configured to support one or more jigsaw puzzle pieces, said jigsaw puzzle pieces forming either an incomplete jigsaw puzzle or a completed jigsaw puzzle; and the securing member is configured to be placed onto the working surface to secure the one or more jigsaw puzzle pieces to the working surface when the frame is in storage mode and when the frame is in transition between storage mode and working mode, and the securing member is further configured to be removable from the working surface when the frame is in working mode, with the securing member being a substantially rigid member removably attached to the lower frame;

wherein the lower frame further comprises a plurality of pivoting flanges, with each said pivoting flange located on a top edge of the perimeter of the lower frame and configured to extend into the interior portion of the lower frame and over the securing member when the securing member is placed onto working surface within the lower frame, such that each of the said plurality of pivoting flanges presses the securing member firmly against the working surface and any jigsaw puzzle pieces located thereon, and with each pivoting flange further configured to be pivoted away from the securing member thereby permitting the securing member to be removed from the working surface and any jigsaw puzzle pieces located thereon.

4. The wall mounted jigsaw puzzle work surface and storage system of claim 3, wherein the attachment member of the frame is a pivotal attachment mechanism, wherein the lower frame is pivotally attached to the wall by the pivotal attachment mechanism.

5. The wall mounted jigsaw puzzle work surface and storage system of claim 3, wherein the frame is further comprised of an upper frame, wherein the upper frame is configured to be secured to the wall by the attachment member, and the lower frame is pivotally attached to the upper frame by a pivotal attachment mechanism.

6. The wall mounted jigsaw puzzle work surface and storage system of claim 5, wherein the upper frame is comprised of a pair of lateral sides, a top side, and a bottom side, with the four sides of the upper frame forming a substantially rectangular structure having an interior space, and the lower frame is dimensioned such that when the frame is in storage mode at least a portion of the lower frame is located within the interior space of the upper frame.

7. The wall mounted jigsaw puzzle work surface and storage system of claim 6, wherein at least a portion of the lower frame is retained within the interior space of the upper frame when the frame is in storage mode by one or more retaining devices.

8. A wall mounted jigsaw puzzle work surface and storage system, said system comprising a frame, a working surface, and a securing member, wherein the frame is comprised of a lower frame and an attachment member, the frame is configured to be secured to a wall by the attachment member, the lower frame is configured to support the working surface, and the frame has a storage mode and a working mode, whereby when the frame is in storage mode the lower frame is oriented substantially vertically, and when the frame is in working mode the lower frame is oriented substantially horizontally;

the working surface is a substantially rigid, substantially planar member configured to be placed onto the lower frame and is further configured to support one or more jigsaw puzzle pieces, said jigsaw puzzle pieces forming either an incomplete jigsaw puzzle or a completed jigsaw puzzle; and the securing member is configured to be placed onto the working surface to secure the one or more jigsaw puzzle pieces to the working surface when the frame is in storage mode and when the frame is in transition between storage mode and working mode, and the securing member is further configured to be removable from the working surface when the frame is in working mode, with the securing member being a substantially rigid member removably attached to the lower frame;

wherein the securing member further comprises a plurality of pivoting flanges, with each said pivoting flange located on the periphery of an upper surface of the securing member, and with each pivoting flange configured to extend into a corresponding groove formed into the perimeter of the lower frame when the securing member is placed onto working surface within the lower frame, such that each of the said plurality of pivoting flanges presses the securing member firmly against the working surface and any jigsaw puzzle pieces located thereon, and with each pivoting flange further configured to be pivoted away from the perimeter of the lower frame permitting the securing member to be removed from the working surface and any jigsaw puzzle pieces located thereon.

9. The wall mounted jigsaw puzzle work surface and storage system of claim 8, wherein the attachment member of the frame is a pivotal attachment mechanism, wherein the lower frame is pivotally attached to the wall by the pivotal attachment mechanism.

10. The wall mounted jigsaw puzzle work surface and storage system of claim 8, wherein the frame is further comprised of an upper frame, wherein the upper frame is configured to be secured to the wall by the attachment member, and the lower frame is pivotally attached to the upper frame by a pivotal attachment mechanism.

11. The wall mounted jigsaw puzzle work surface and storage system of claim 10, wherein the upper frame is comprised of a pair of lateral sides, a top side, and a bottom side, with the four sides of the upper frame forming a substantially rectangular structure having an interior space, and the lower frame is dimensioned such that when the frame is in storage mode at least a portion of the lower frame is located within the interior space of the upper frame.

12. The wall mounted jigsaw puzzle work surface and storage system of claim 11, wherein at least a portion of the lower frame is retained within the interior space of the upper frame when the frame is in storage mode by one or more retaining devices.

13. A wall mounted jigsaw puzzle work surface and storage system, said system comprising a frame, a working surface, and a securing member, wherein the frame is comprised of a lower frame and an attachment member, the frame is configured to be secured to a wall by the attachment member, the lower frame is configured to support the working surface, and the frame has a storage mode and a working mode, whereby when the frame is in storage mode the lower frame is oriented substantially vertically, and when the frame is in working mode the lower frame is oriented substantially horizontally;

the working surface is a substantially rigid, substantially planar member configured to be placed onto the lower frame and is further configured to support one or more jigsaw puzzle pieces, said jigsaw puzzle pieces forming either an incomplete jigsaw puzzle or a completed jigsaw puzzle; and the securing member is configured to be placed onto the working surface to secure the one or more jigsaw puzzle pieces to the working surface when the frame is in storage mode and when the frame is in transition between storage mode and working mode, and the securing member is further configured to be removable from the working surface when the frame is in working mode, with the securing member comprising a substantially rigid outer member attached to a compressible inner layer, with the inner layer oriented towards the working surface when the securing member is placed thereon;

wherein the securing member further comprises a non-stick contact layer that is attached to the inner layer of the securing member on a surface of the inner layer opposite the outer member of the securing member, whereby the contact layer of the securing member is in contact with the one or more jigsaw puzzle pieces that may be located on the working surface when the securing member is placed onto the work surface.

14. The wall mounted jigsaw puzzle work surface and storage system of claim 13, wherein the attachment member of the frame is a pivotal attachment mechanism, wherein the lower frame is pivotally attached to the wall by the pivotal attachment mechanism.

15. The wall mounted jigsaw puzzle work surface and storage system of claim 13, wherein the inner layer of the securing member is air permeable.

16. The wall mounted jigsaw puzzle work surface and storage system of claim 13, wherein the frame is further comprised of an upper frame, wherein the upper frame is configured to be secured to the wall by the attachment member, and the lower frame is pivotally attached to the upper frame by a pivotal attachment mechanism.

17. The wall mounted jigsaw puzzle work surface and storage system of claim 16, wherein the upper frame is comprised of a pair of lateral sides, a top side, and a bottom side, with the four sides of the upper frame forming a substantially rectangular structure having an interior space, and the lower frame is dimensioned such that when the frame is in storage mode at least a portion of the lower frame is located within the interior space of the upper frame.

18. The wall mounted jigsaw puzzle work surface and storage system of claim 17, wherein at least a portion of the lower frame is retained within the interior space of the upper frame when the frame is in storage mode by one or more retaining devices.

19. The wall mounted jigsaw puzzle work surface and storage system of claim 13, wherein the lower frame is substantially planar and comprises a perimeter and an interior portion circumscribed by said perimeter; and the lower frame further comprises a base panel located within the interior of the lower frame, said base panel configured to support the working surface when the working surface is placed onto the lower frame within the interior of the lower frame, with the base panel of the lower frame being transparent and removable from the lower frame.

* * * * *